US005678779A

United States Patent [19]

Maina

[11] Patent Number: 5,678,779

[45] Date of Patent: Oct. 21, 1997

[54] YARN FEEDING DEVICE WITH SELF-ADJUSTING BRAKING MECHANISM

[75] Inventor: Bruno Maina, Valdengo, Italy

[73] Assignee: Nuova Roj Electrotex S.r.l., Biella, Italy

[21] Appl. No.: 446,603

[22] PCT Filed: Nov. 22, 1993

[86] PCT No.: PCT/EP93/03262

§ 371 Date: Jul. 3, 1995

§ 102(e) Date: Jul. 3, 1995

[87] PCT Pub. No.: WO94/12420

PCT Pub. Date: Jun. 9, 1994

[30] Foreign Application Priority Data

Nov. 23, 1992 [IT] Italy ..... MI92A2678

[51] Int. Cl.[6] ..... B65H 51/00; B65H 59/22; D03D 47/36

[52] U.S. Cl. ..... 242/47.01; 242/149; 139/452

[58] Field of Search ..... 242/47.01, 149; 139/452

[56] References Cited

U.S. PATENT DOCUMENTS

| | | | |
|---|---|---|---|
| 3,411,548 | 11/1968 | Pfarrwaller | 139/452 |
| 4,068,807 | 1/1978 | Jacobsson | 242/47.01 |
| 4,261,526 | 4/1981 | Roj | 242/47.01 |
| 4,429,723 | 2/1984 | Maroino | 242/47.01 X |
| 4,926,912 | 5/1990 | Zenoni | 139/452 |
| 5,046,536 | 9/1991 | Zenoni | 139/452 |
| 5,316,051 | 5/1994 | Zenoni et al. | 242/47.01 X |
| 5,343,899 | 9/1994 | Jacobsson et al. | 242/47.01 X |

FOREIGN PATENT DOCUMENTS

| | | | |
|---|---|---|---|
| 0 482 688 | 4/1992 | European Pat. Off. . | |
| 0 536 088 | 4/1993 | European Pat. Off. | 139/452 |

*Primary Examiner*—Michael Mansen
*Attorney, Agent, or Firm*—Young & Thompson

[57] ABSTRACT

Yarn feeding device for projectile or gripper looms, having a drum (D) to store the yarn (Y), an inclined annular deflection surface (G) at the free front end of the drum (D), a circumferentially continuous and yielding conical braking surface (B) at the wider end of a hollow conical brake carrier (C), pressed in contact with the deflection surface (G). The brake carrier (C) is supported at its smaller end onto a stationary part (P) and the braking surface (B) is adjustable with respect to the deflection surface (G), according to the yarn unwinding speed, so as to compensate for any tension increase in the yarn (Y), and an annular counterdeflection surface (H) for the yarn (Y), downstream of the deflection surface (G) and coaxial to the drum (D). The inside diameter of the counterdeflection surface (H) is smaller than the outside diameter of the deflection surface (G). The annular counterdeflection surface (H) is stationary, and the braking surface (B) is adjusted exclusively by direct contact of the yarn (Y), through deformation and/or displacement of the brake carrier (C) with respect to the fixed counterdeflection surface (H).

11 Claims, 4 Drawing Sheets

YARN FEEDING DEVICE WITH SELF-ADJUSTING BRAKING MECHANISM

The invention concerns a yarn feeding device with a self adjusting braking mechanism.

BACKGROUND OF THE INVENTION

In a yarn feeding device as known from U.S. Pat. No. 4,068,807, the conical yarn braking surface is defined by the inner circumference of an elastic synthetic rubber ring, fixed to the base of a rigid frustoconical brake carrier. A yarn guide eyelet, fixed to the small diameter end section of the brake carrier, acts as counterdeflection surface. The brake carrier is fixed with its small end section into a bearing, mounted axially slidable—essentially in a direction of the drum axis—into the stationary part of the feeder. A spring acts as pre-loading element and presses the braking surface in an axial direction against the inclined deflection surface. A detection device detects yarn tension and adjusts the brake carrier so as to oppose the pre-loading force and thus reduce the braking effect between the braking surface and the deflection surface, as yarn tension increases. During unwinding of the yarn, its tension increases in proportion to the unwinding speed, and the braking surface thus reduces its braking effect on the yarn so as to compensate for the yarn tension increase resulting from the unwinding speed.

The same principle—i.e. to reduce the braking effect between the braking surface and the deflection surface, as yarn tension increases—is adopted in a yarn feeding device known from the publication "TWM", INFORMA 92, of L.G.L. ELECTRONICS S.p.A., Gandino, Italy. In this case, the braking surface is defined by the inner circumference of a conical metal plate ring, fixed to the inner side of the wide diameter end section of a carbon fiber cone. The counterdeflection surface is defined by the conical lining inside the small diameter end section of the cone. The cone is mounted with its small end into an annular ring membrane, fixed to the stationary part of the feeder and forming the pre-loading element. The yarn slides between the braking surface and the deflection surface, and then inwardly and around the counterdeflection surface, transmitting the axial components of its tension, while the cone is simultaneously kept balanced by the membrane. In this way, the axial component of yarn tension shifts the braking surface against the action of the membrane, as soon as yarn tension increases on rising of the unwinding speed, in order to reduce the braking action.

The prior art on the subject includes also FR-A-2.422.577, EP-A-49.897 and EP-A-330.951, which foresee the use of braking means formed by a plurality of metal laminae cooperating with the drum of the weft feeder, as well as the possibility to adjust the pre-loading force with which the braking means are pressed upon the drum.

SUMMARY OF THE INVENTION

In view of the ever increasing yarn unwinding speeds of modern projectile or gripper looms, the object of the present invention is to supply a yarn feeding device of the aforementioned type, wherein yarn tension is detected with high sensitiveness, and the braking action is exactly adapted to the force vectors of the sliding yarn and efficiently adjusted, without perceptibly disturbing yarn movement.

According to the invention, this object is reached with a yarn feeding device for projectile and gripper looms, comprising a storage drum for storing turns of a yarn which is tangentially wound thereon into turns, and is unwound from the turns in an essentially axial unwinding direction over an inclined annular and rounded deflection surface provided at a free front end of the storage drum and under a conical braking surface provided at a wider end of a hollow conical brake carrier. The brake carrier also has a smaller end and is arranged essentially coaxial of the storage drum, with the wider end overlapping the annular and rounded deflection surface. The brake carrier is provided with openings defining separate spring tongues ending in correspondence of the braking surface. The tongues extend up to the smaller end of the brake carrier. The braking surface is pressed in contact with the rounded deflection surface via the brake carrier along a common line of contact with an approximately axial elastic pre-loading force imparted by a pre-loading element onto the brake carrier for generating a braking action on the yarn during unwinding. The brake carrier is supported at its smaller end via a stationary part positioned downstream of the front end of the storage drum. The braking surface is adjustable in respect of the deflection surface, at least approximately in axial direction of the storage drum according to momentary yarn unwinding speed, so as to reduce the braking action and compensate for tension increases in the yarn caused by increasing yarn unwinding speed. A stationary annular counterdeflection surface for the yarn is positioned downstream of the deflection surface and coaxial to the storage drum. The counterdeflection surface has an inner diameter considerably smaller than the outside diameter of the deflection surface. The braking surface comprises a circumferentially continuous inner smooth and abrasion-proof face of a ring-shaped brake element made of one of metal and plastic, which extends in and against the unwinding direction of the yarn over the line of contact with the rounded deflection surface. The brake element and the brake carrier are constructed and arranged to undergo significant elastic bending deformability in a radial direction with respect to the rounded deflection surface when the yarn is unwound. The braking surface is adjustable in operation due to a direct contact action of the yarn by deformation and displacement of the brake carrier and the brake element with respect to the stationary annular counterdeflection surface. The brake element and the brake carrier are flexible in a torsional direction about the line of contact thereby allowing a local distortion and tilting deformation of the brake element and the brake carrier about the line of contact, and in relation to the rounded deflection surface in response to a tension increase in the yarn being unwound between the braking surface and the rounded deflection surface.

It is deemed that this construction, with the fixed counterdeflection surface separate from the braking surface, prevents the counterdeflection surface, or the force vectors, generated by the rubbing yarn, acting on said surface, from affecting the adjustment of the braking action. The braking surface responds directly and alone, extremely sensitively and promptly to any force vectors generated by the yarn causing friction. So long as the yarn moves at a low unwinding speed, the braking surface and the deflection surface produce an efficient braking effect, which is particularly desirable in the case of projectile or gripper looms. But if the yarn unwinding speed notably increases, on rising of the speed and of the yarn centrifugal force, as the yarn moves around the deflection surface, a sickle-shaped opening or relief zone is created between the deflection surface and the braking surface, which thereby deforms. Due to such opening or relief zone, the yarn travels with a considerably reduced resistance when its unwinding speed is higher. The opening or relief zone rotates with the yarn unwinding point around the deflection surface like a wave distortion which spreads circumferentially along the braking surface.

Probably, the sickle-shaped opening or relief zone results from a partial tilting and distorting motion of the deformable braking surface on the brake carrier, correspondingly elastic, and in relation to the deflection surface, as well as from an oval bend in the normally circular braking surface. Before and after the sickle-shaped opening, in the direction of rotation, the braking surface is kept in biased contact with the deflection surface, so that the opening rotates smoothly and without appreciable vibrations around the braking surface. As soon as the yarn unwinding speed decreases, the braking surface automatically moves back into its original position on the deflection surface, under the influence of the biasing member and due to its own elasticity, so that it tends to establish again, as much as possible, a circular zone or line of contact with the deflection surface. During tilting, distorting and deforming of the braking surface, the downstream yarn is permanently guided by the fixed counterdeflection surface. It is believed that the sickle-shaped opening or relief zone, which distinguishes itself by an extremely narrow angle with the circular circumference of the deflection surface, results from the scarce resistance to tilting and distortion of the braking surface and from its radial deformability in the zone of yarn contact, even though the braking surface remains biased on the deflection surface over the rest of its inner circumference. The yarn actually slides through the sickle-shaped opening or relief zone, at an increasing unwinding speed, with a decreasing resistance. It should also be noted that in the dynamic phase of yarn unwinding at highest speed, the mechanical effect deriving from the yarn contact on the braking surface and on the deflection surface and from the yarn friction forces acting thereon, leads to an unexpected yielding of the braking surface and to an unexpected reduction of the braking effect. In modern looms, the rotation speed of the yarn unwinding point is so high that, in the dynamic phase, the whole braking surface can be lifted and the inertia of the system is no longer sufficient to press the braking surface against the deflection surface, inasmuch as the deformation work of the braking surface and that of the brake carrier greatly absorb pre-compression. Another explanation of the effect is that the yarn friction force displaces a circumferential section of the braking surface, with respect to the remaining part thereof, in the yarn unwinding direction. In fact, this circumferential section of the braking surface, which undergoes a so-called distortion, performs a tilting movement with respect to the front end of the yarn storage drum. The contact line between the braking surface and the deflection surface is slightly shifted towards the front end of the storage drum, since the braking surface is conical and the deflection surface is rounded. Since, as a result of such displacement, the length of the contact line between the braking surface and the curved deflection surface of the drum is reduced, and since the braking surface is radially deformable, the contact pressure of the surface on the deflection surface thereby decreases. It is even possible for the braking surface to be lifted from the deflection surface. Yarn braking diminishes or ceases. During this local displacement of the contact line onto a smaller diameter of the deflection surface, and due to the slight tilting movement of this circumferential section of the braking surface, the yarn contact point with the braking surface gets closer to the axis of the storage drum. The lever arm of the reaction force by friction of the yarn against the braking surface consequently becomes shorter, thereby reducing the braking torque which opposes the rotary motion of the yarn unwinding point. It should moreover be considered that the yarn sliding through the braking space, which yarn has a specific elasticity of its own and is compressible, gets less and less compressed as its unwinding speed increases, in that the braking surface and the deflection surface have less and less time to squeeze the yarn as its unwinding speed becomes higher. The deformation work which brakes the yarn decreases; due to the yarn being less and less compressed, the tilting and distortion of the braking surface increase even further, and also its parting from the deflection surface, thereby increasing the local displacement of the contact line between the braking surface, thereby increasing the local displacement of the contact line between the braking surface and the deflection surface over a smaller diameter of this last surface. This in turn leads to a further widening of the sickle-shaped opening or relief zone in which the yarn finds itself. It may even be that with a top yarn unwinding speed, in the presence of the previously mentioned wave distortion which spreads circumferentially, a fairly stable condition may be created in the braking surface, with a reduced braking action on the yarn. Seen that the counterdeflection surface no longer forms part of the brake carrier, nor does it have to be supported by the same, the brake carrier can be made extremely light weighted and yielding practically in every direction, or according to all degrees of freedom, except in an axial direction. This improves the sensitiveness of the braking surface adjustment according to the yarn unwinding speed. This means that the braking effect is reduced when there is a high increase in the unwinding speed; but, it again increases when the yarn unwinding speed drops down. The yieldable braking surface, which automatically reacts with the brake carrier under the effect of yarn contact, is adapted, in cooperation with the brake carrier, to respond to unwinding conditions which are critical for the yarn, i.e. to undesirable increases of yarn tension determined by the unwinding speed, and is consequently in a position to automatically adjust itself, so as to reduce the braking action on which the yarn tension ultimately depends. The braking surface can be made extremely flexible in a radial and torsional direction. It hence reacts with high sensitiveness to yarn contact, although it remains supported by the deflection surface along a contact length of more than half of a complete circle. However, the bearing of the braking surface compressed in an axial direction by the deflection surface, does not negatively affect the formation of the sickle-shaped opening or relief zone, in that, ahead of, and behind the yarn unwinding point, the bearing pressure is automatically reduced, or even disappears when the yarn unwinding point rotates about the storage drum at a higher yarn unwinding speed. The resistance of the braking surface to the opening of the sickle-shaped interspace might become so low that, under the effect of yarn centrifugal force, the braking surface might even be lifted from the deflection surface. In other words, as yarn speed increases, the yarn drags along by friction force, approximately in the unwinding direction, for at least a circumferential section of the braking surface, till the contact line between the braking surface and the deflection surface is partially shifted towards the drum axis and the braking surface clears the way for the yarn in the sickle-shaped opening or relief zone, with a remarkably reduced resistance.

BRIEF DESCRIPTION OF THE DRAWINGS

The characteristics and advantages of the yarn feeding device of the present invention will anyhow be more evident from the following detailed description of some preferred embodiments thereof, given by way of example and illustrated on the accompanying drawings, in which.

DETAILED DESCRIPTION OF THE INVENTION

Figure 1:
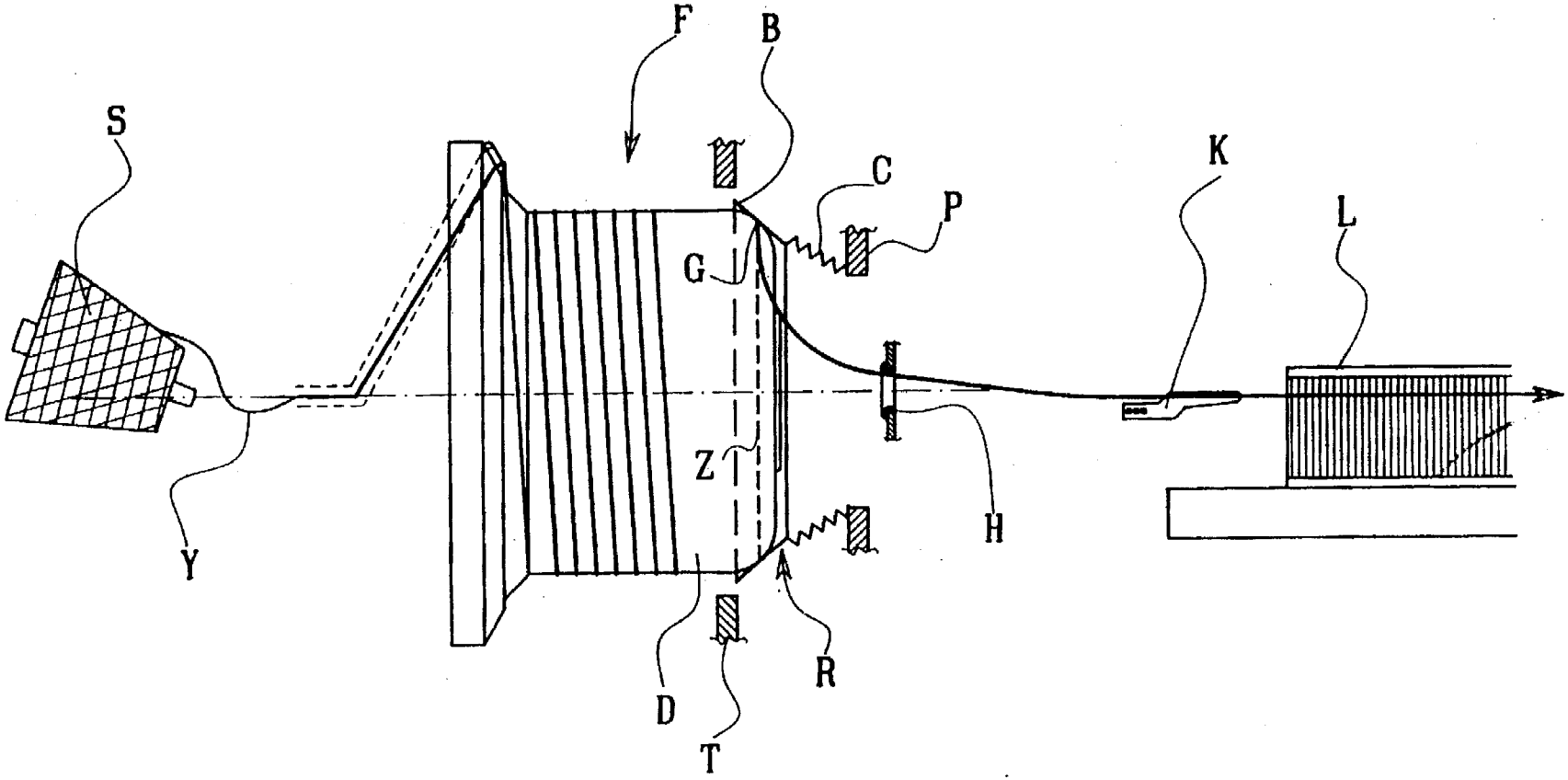
FIG. 1 is a diagrammatic side view of a loom yarn feeding device.

As shown in FIG. 1, in a system to feed weft yarn to a loom, the yarn Y is withdrawn from a spool S and is tangentially wound into turns by means of a winding device operated by a motor around the outer surface of a storage drum D of the yarn feeding device. The yarn Y is used by a loom L which draws it from the front end of the storage drum D, by means of a weft picking member K. The front end of the storage drum D terminates into a circular and rounded deflection surface G. A braking element R, in the form of a frustoconical ring, surrounds the deflection surface G. The inner face of the braking element R defines a circumferentially continuous conical braking surface B of predetermined axial length. The braking element R is pressed in a substantially axial direction against the storage drum D with a pre-loading force imparted by a pre-loading element. A line of contact Z, which is at least theoretically circular, is formed between the braking surface B and the deflection surface G. The diameter on the left side of the braking surface B is wider than the diameter of the contact line Z. The diameter on the right side of the braking surface B is smaller than that of the contact line Z.

The braking element R is carried by a suitably conical, hollow brake carrier C, which is supported by a stationary part P downstream of the front end of the storage drum D. The braking element R is fixed into the wider end of the brake carrier C. The brake carrier C is relatively rigid in an axial direction so as to transmit the pre-loading imparted by the pre-loading element while being instead deformable in every other direction. The brake carrier can form itself the pre-loading element. It can however also be conceived to axially compress the smaller end of the brake carrier C by means of a pre-loading element supported by the stationary part P.

Downstream of the front end of the storage drum D, an annular stationary counterdeflection surface H is provided, suitably in the form of a fixed yarn guide eyelet. The inside diameter of the counterdeflection surface is considerably smaller than that of the braking surface B. Downstream of the counterdeflection surface H, the yarn Y can be gripped by a weft picking member K of the loom (projectile or gripper loom), which inserts the yarn into the shed. On unwinding, the yarn Y is drawn from the tangential turns wound on the storage drum D and slides over the deflection surface G and under the braking surface B, before deviating in an oblique direction towards the drum axis and sliding with a new deviation, more or less in a direction of the drum axis, over the counterdeflection surface H.

Figure 2B:
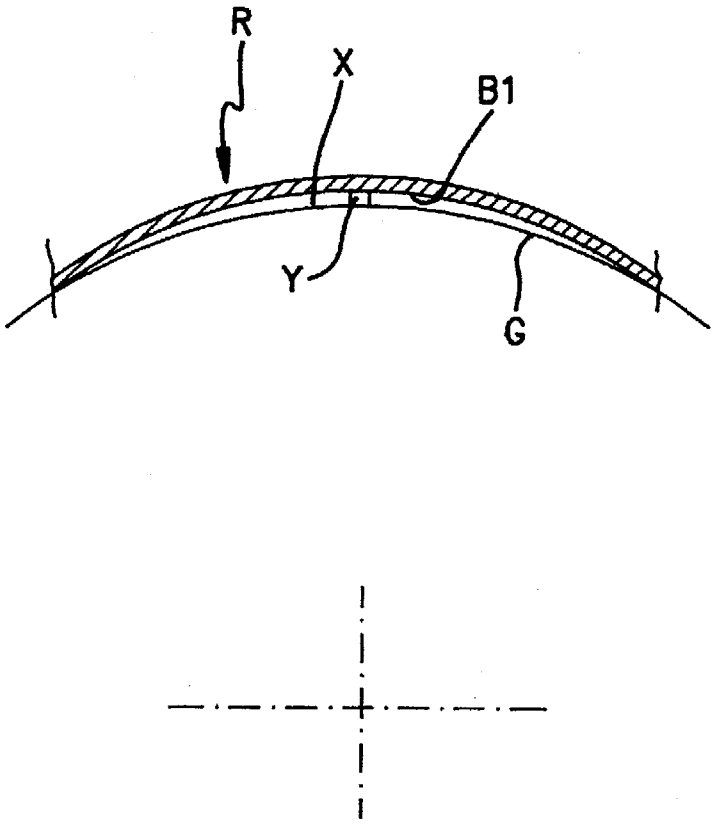
FIG. 2*b* is a cross section view taken along line 2*b*—2*b* of FIG. 2*a;*
Figure 2A:
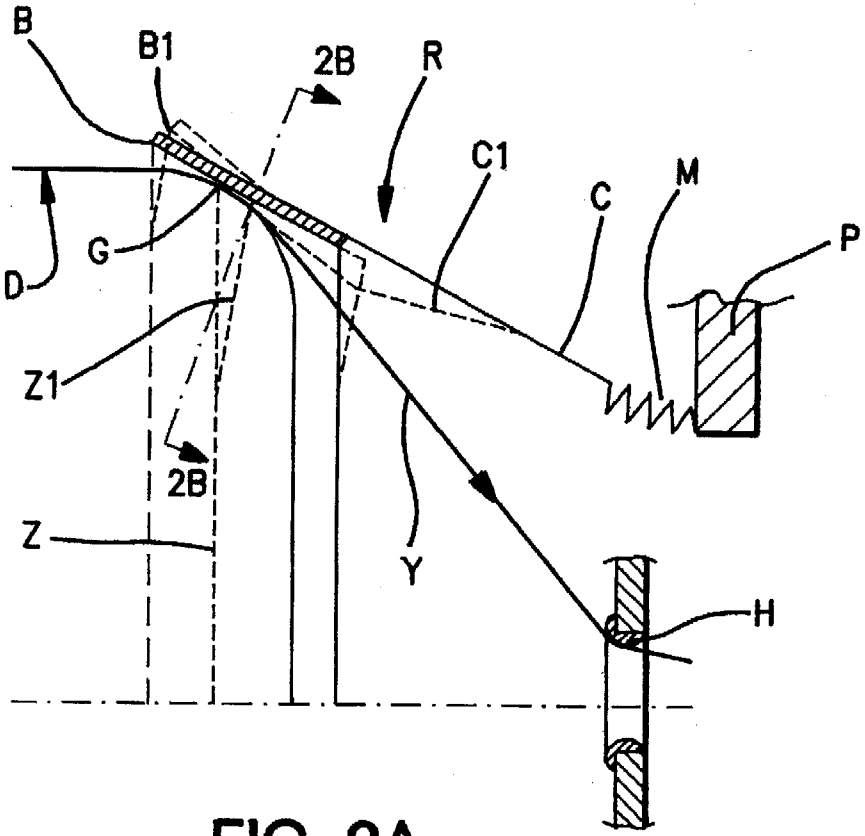
FIG. 2*a* is an axial section view, on an enlarged scale of the device shown in FIG. 1.

FIGS. 2*a* and 2*b* show how the braking surface B is tilted and distorted, by sliding of the yarn Y, in a limited peripheral zone, thereby shifting from the position indicated in full lines to an offset and distorted position B1 indicated by dashed lines. This displacement of the braking surface B derives from the fact that this surface cannot extend in a circumferential direction, to clear the way for the yarn Y, but is shifted under the pressure of the yarn Y being unwound and thus sliding around the deflection surface G. The braking surface B undergoes only a local deformation ahead of, and behind the yarn unwinding point, whereby the normally circular contact line Z is locally shifted towards the front end of the storage drum D. Consequently, since the diameter of the deflection surface G is rapidly reduced on account of the curvature, the shifting results into a shorter contact line Z1, whereby in this zone the braking surface B yields outwardly and deforms, taking up an oval shape. A sickle-shaped opening or relief zone X is thus formed of between the braking surface B, in its position B1, and the deflection surface G, so that, in spite of the axial biasing force the braking surface B, as yarn speed rises the braking action on the yarn is reduced. The brake carrier C allows, or follows, the local deformation or displacement of the braking element R (indicated in dashes by C1). The sickle-shaped opening X and the shifting of the contact line Z into the position Z1 are shown in detail in FIGS. 2*a* and 2*b*. Due to shifting of the contact line in its position Z1, the yarn clamping point between the braking surface B and the deflection surface G gets closer to the axis of the storage drum D, thereby reducing the lever arm of the reaction force due to yarn friction. There ensues a decreasing resistance for the rotation movement of the yarn unwinding point around the deflection surface G. This also involves a reduced braking action upon increase of the yarn unwinding speed, which compensates for, i.e. reduces, the high yarn tension level at high yarn unwinding speeds. FIG. 2*a* shows the pre-loading element M in the form of a spring between the brake carrier C and the stationary part P.

Figure 3:
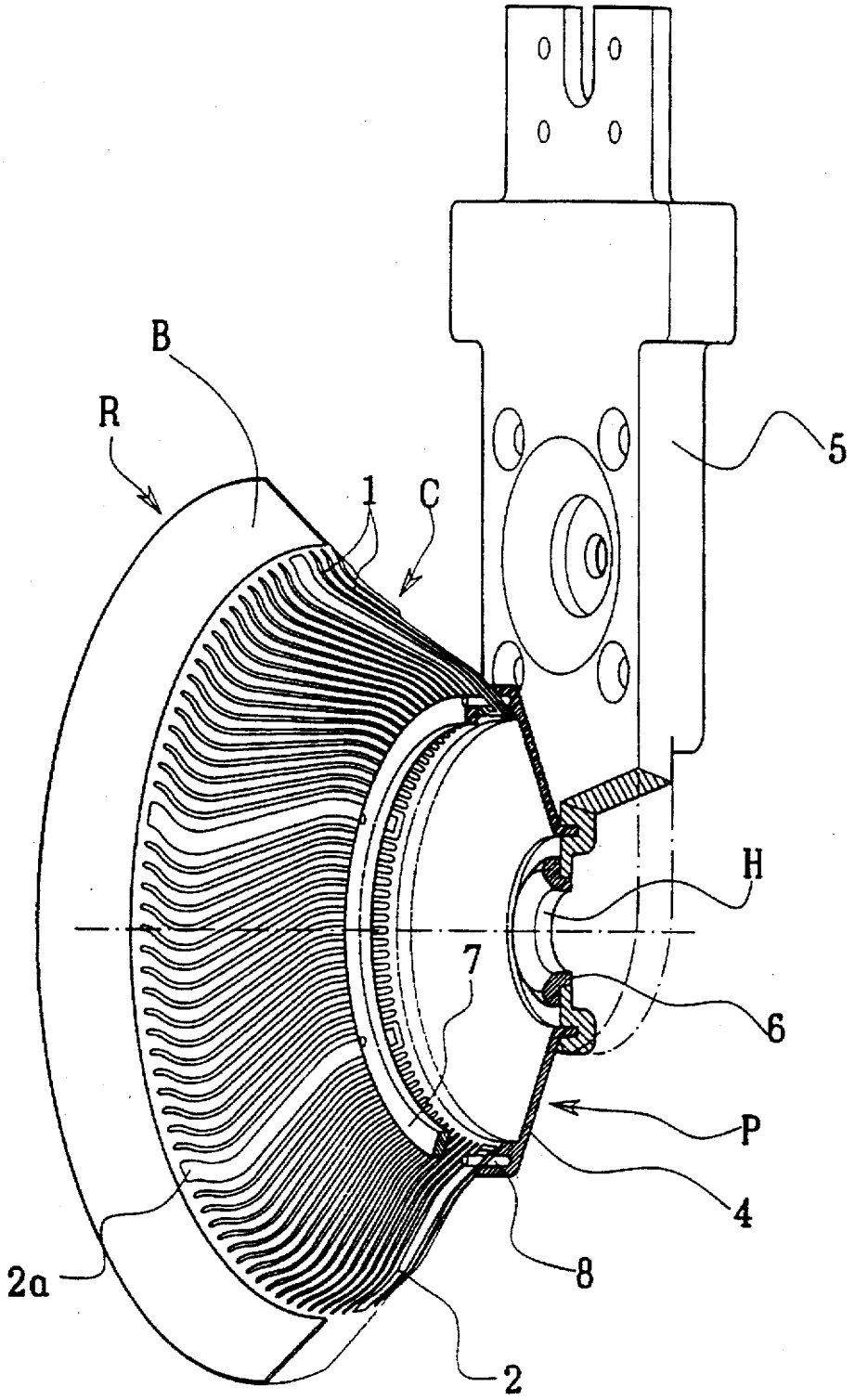
FIG. 3 is a perspective sectional view of a practical embodiment of the yarn feeder according to the invention, with some parts removed.

In the practical embodiment of the invention shown in FIG. 3, the braking element R is a ring formed by a plastic metal (or metal alloy) plate having a smooth and highly wearproof surface. The ring is fixed to the inner surface of the wider end of the brake carrier C or even forms part of the brake carrier. The brake carrier has a frustoconical shape and is made, for example, from a thin sheet of steel for springs. The brake carrier C is provided with a plurality of openings 2 adjacent to the braking surface B, for instance in the form of axial or S-shaped slits which extend as far as the smaller diameter end section of the braking surface, and which define spring tongues 1. The tongues 1 extend between the braking surface B and the smaller end of the brake carrier C, where the free ends of at least some of the adjacent tongues 1 (but possibly also all) can be interconnected. The stationary part P has the shape of a cup 4, anchored with its base into a fixed support arm 5. Into the base of the cup 4 there is fixed a yarn guide eyelet 6 which defines the counterdeflection surface H, facing the front end of the storage drum D, abuts on the outer sides of the tongues 1 so as to transmit the axial biasing force to the braking element R. Into the cup 4 there are fixed a plurality of equally spaced axial coupling pins 8. Each coupling pin 8 extends through one of the openings 2, such as a suitably widened opening 2*a*, or through a hole of a tongue 1, into the brake carrier C. At the ends of the coupling pins 8 there is fixed a ring element 7, acting as stop, which is in contact with the inner surface of the tongues 1. Due to pressure on the deflection surface G, the tongues 1 are adapted to bend so that, when the biasing force acts, the brake carrier C will more or less take the shape of a cup. In spite of this, the wider end of the brake carrier C is likely to undergo together with the braking surface B, with a slight strain strength, a local tilting and distortion. A screw can be provided between the support arm 5 and the cup 4 to adjust the pre-loading force. It can however also be conceived to axially move the support arm 5 by means of an adjusting screw, not shown.

Figure 4:
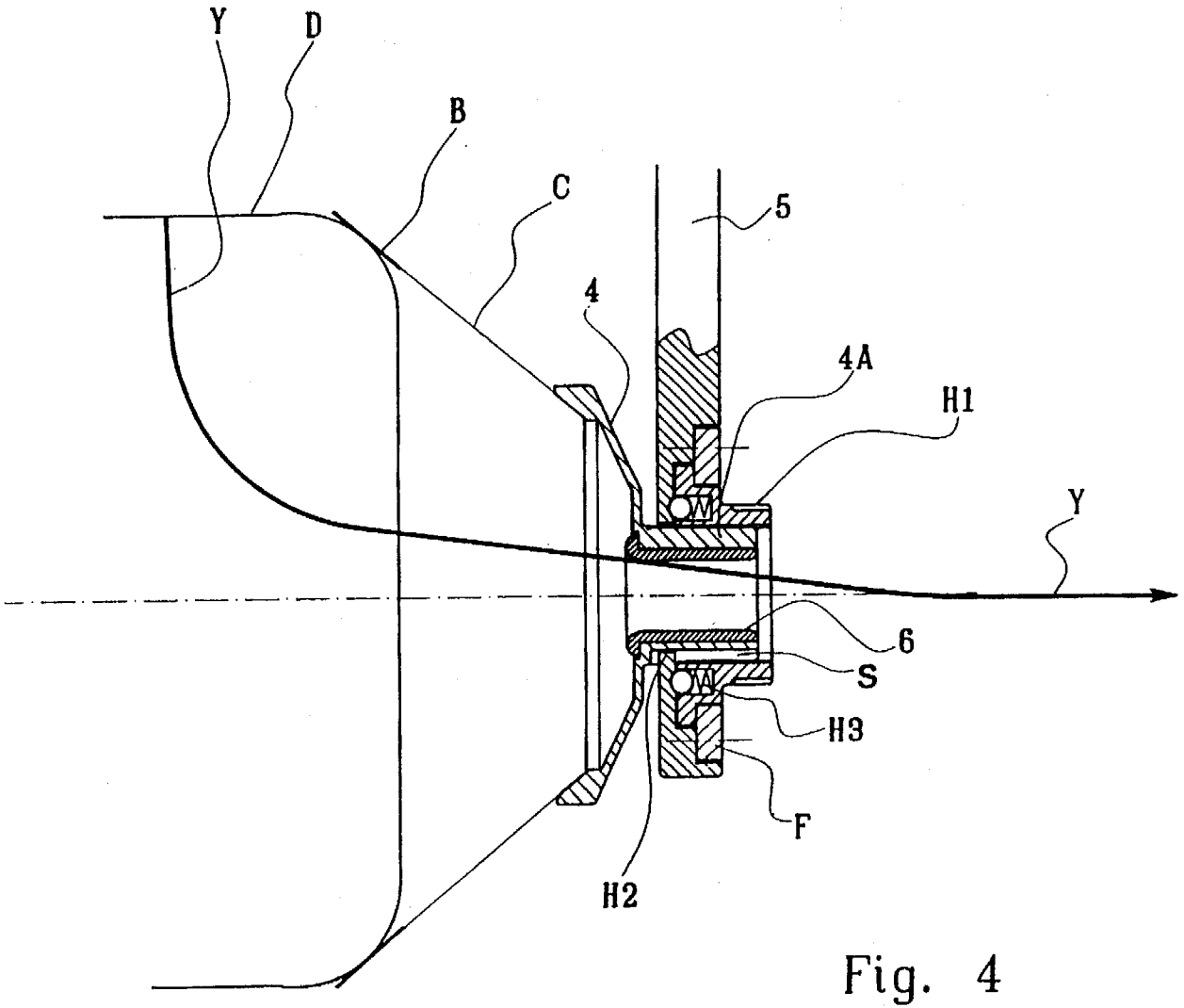
FIG. 4 shows means to adjust the pre-loading force on the yarn braking element in the yarn feeder according to the invention.

FIG. 4 illustrates an arrangement to adjust the preloading force, by which the braking surface B of the brake carrier C is pressed against the front end of the storage drum D.

According to this arrangement, the knob or screw H1 and a spring system H3 are held by a ring F into the fixed support arm 5. An inner thread of the knob H1 engages into an outer thread of the hub part 4A of the cup support 4. The tooth H2 projecting from the fixed support arm 5 engages into a longitudinal groove or slit S in the knob H1, so as to obtain an axial movement of the cup support 4 when the knob H1 is being turned. In this way, by rotating the knob H1 it is possible to axially shift the cup support 4, and this determines an increase or a reduction in the pre-loading force by which the brake carrier C and the braking surface B are compressed against the front end of the drum D.

Nevertheless, instead of adopting the solution shown in FIG. 4, it is also possible to adjust the pre-loading force by more conventional means, with a so-called guide device or slider, known per se. In this case the whole support arm 5, into which is fixed the cup support 4, can be axially shifted forward and backward with respect to the front end of the drum D. This is preferably also achieved by means of an adjusting screw or knob, which determines the axial position of a slider carrying the support arm 5. The slider is axially movable with the arm 5 into a fixed longitudinal bracket of the yarn feeding device, extending along the whole drum D and even beyond its front end.

FIG. 1 also shows the possibility to dispose of a device T upstream of the braking element R, to limit or remove "balloons", supported independently from the braking element and from the brake carrier C.

According to the invention, due to the reduced braking action as yarn unwinding speed increases, it is possible to obtain a relatively constant and limited yarn tension level.

I claim:

1. Yarn feeding device for projectile and gripper looms, comprising:

a storage drum for storing turns of a yarn which is tangentially wound thereon into said turns, and is unwound from said turns in an essentially axial unwinding direction over an inclined annular and rounded deflection surface provided at a free front end of said storage drum;

a brake comprising a hollow conical brake carrier, a stationary part for supporting a smaller end of said brake carrier, and a ring shaped brake element at a wider end of said brake carrier, said brake element being made of one of metal and plastic and having a circumferentially continuous inner smooth and abrasion-proof face forming a conical braking surface, said brake carrier being arranged essentially coaxial of said storage drum, said wider end overlapping said annular and rounded deflection surface, said brake carrier being provided with openings defining separate spring tongues ending in correspondence of the braking surface, said tongues extending up to the smaller end of the brake carrier, said tongues permitting torsional flexure of said brake element and said brake carrier about a line of contact between said braking surface and said rounded deflection surface thereby allowing a deformation of said braking surface in relation to said rounded deflection surface in response to a tension increase in the yarn when the yarn is being unwound;

a preloading element for pressing said braking surface in contact with said rounded deflection surface via said brake carrier along the line of contact with an approximately axial elastic pre-loading force for generating a braking action on said yarn when the yarn is being unwound, said brake element and said brake carrier being elastically deformable in a radial direction with respect to said rounded deflection surface; and a stationary annular counterdeflection surface for said yarn positioned downstream of said deflection surface and coaxial to said storage drum, said counterdeflection surface having an inner diameter considerably smaller than an outside diameter of said deflection surface.

2. Yarn feeding device according to claim 1, wherein the tongues are firmly connected to the stationary part and form at least in part the preloading element.

3. Yarn feeding device according to claim 1, wherein ends of at least some adjacent tongues are interconnected, in a circumferential direction, at the smaller end of the brake carrier, said smaller end of the brake carrier being connected to an annular body of the stationary part, said body abutting on outer sides of the tongues, said stationary part having at least a coupling pin mounted thereon, which engages into one of the openings of a tongue, and with which cooperate means to prevent the brake carrier from slipping out of said coupling pin.

4. Yarn feeding device according to claim 3, wherein the stationary part is in the form of a cup having a passage for the yarn, into which are provided equally spaced coupling pins adapted to engage with slack into the brake carrier, and the ring is fixed to the coupling pins inside the brake carrier.

5. Yarn feeding device according to claim 1, wherein the counterdeflection surface and the brake carrier of the braking surface are both supported on the stationary part.

6. Yarn feeding device according to claim 1, further comprising a device positioned upstream of the braking surface and supported independently from the braking surface for limiting balloons.

7. Yarn feeding device according to claim 1, wherein the stationary part further comprises means for adjusting the preloading element.

8. Yarn feeding device for projectile and gripper looms, comprising:

a storage drum for storing turns of a yarn which is tangentially wound thereon into said turns, and is unwound from said turns in an essentially axial unwinding direction over an inclined annular and rounded deflection surface provided at a free front end of said storage drum;

a brake comprising a hollow conical brake carrier, a stationary part for supporting a smaller end of said brake carrier, and a ring shaped brake element at a wider end of said brake carrier, said brake element being made of one of metal and plastic and having a circumferentially continuous inner smooth and abrasion-proof face forming a conical braking surface, said brake carrier being arranged essentially coaxial of said storage drum, said wider end overlapping said annular and rounded deflection surface, said brake element and said brake carrier being torsionally flexible about a line of contact between said braking surface and said rounded deflection surface thereby allowing a local distortion and deformation of said braking surface in relation to said rounded deflection surface in response to a tension increase in the yarn when the yarn is being unwound;

a preloading element for pressing said braking surface in contact with said rounded deflection surface via said brake carrier along the line of contact with an approximately axial elastic pre-loading force for generating a braking action on said yarn when the yarn is being unwound, said brake element and said brake carrier being elastically deformable in a radial direction with respect to said rounded deflection surface; and a stationary annular counterdeflection surface for said yarn positioned downstream of said deflection surface and coaxial to said storage drum, said counterdeflection surface having an inner diameter considerably smaller than an outside diameter of said deflection surface.

9. Yarn feeding device according to claim 8, wherein the counterdeflection surface and the brake carrier of the braking surface are both supported on the stationary part.

10. Yarn feeding device according to claim 8, further comprising a device positioned upstream of the braking surface and supported independently from the braking surface for limiting balloons.

11. Yarn feeding device according to claim 8, wherein the stationary part further comprises means for adjusting the preloading element.

* * * * *